United States Patent [19]

Escamilla-Kelly

[11] 4,348,027

[45] Sep. 7, 1982

[54] MULTI-LEVEL GAME BOARD APPARATUS

[76] Inventor: Ricardo Escamilla-Kelly, 14123 Rosetta, Cypress, Tex. 77429

[21] Appl. No.: 266,844

[22] Filed: May 26, 1981

[51] Int. Cl.[3] ..... A63F 3/02

[52] U.S. Cl. ..... 273/241; 273/260; 273/280; 273/284

[58] Field of Search ..... 273/241, 260, 280, 284, 273/261; D21/23

[56] References Cited

U.S. PATENT DOCUMENTS

| | | | |
|---|---|---|---|
| D. 200,109 | 1/1965 | Hirsch | 273/241 X |
| 3,610,626 | 10/1971 | Nolte | 273/26 |
| 3,840,237 | 10/1974 | Shkolnik | 273/261 |
| 3,897,063 | 7/1975 | Lehwalder | 273/280 |

FOREIGN PATENT DOCUMENTS

| | | | |
|---|---|---|---|
| 218607 | 2/1910 | Fed. Rep. of Germany | 273/261 |
| 2951790 | 7/1980 | Fed. Rep. of Germany | 273/261 |
| 601302 | 5/1948 | United Kingdom | 273/241 |

*Primary Examiner*—Richard C. Pinkham
*Assistant Examiner*—Scott L. Brown
*Attorney, Agent, or Firm*—Neal J. Mosely

[57] ABSTRACT

A multi-level game board apparatus, adapted to be played with playing pieces such as chess men or the like, consists of a chess or checker board divided into a plurality of levels for play. The board appears, in plan view, to have the arrangement of bilaterally colored dark and light squares of the shape and number of squares of a conventional chess or checker board. The board, however, is separated into a central portion at one level and a plurality of surrounding portions of square configuration separately supported at least at one other level. The separate square portions supported at another level are separately supported on support members permitting rotation of each square portion about its center. In the play of the game, the playing pieces are placed on the board initially, and are moved, as if all of the portions of the board were in a single plane. The game differs from a standard game board, however, in that one or more of said portions supported at different levels may be rotated to position a playing piece at a different relative location without moving the piece on the surface of the board.

9 Claims, 5 Drawing Figures

MULTI-LEVEL GAME BOARD APPARATUS

BACKGROUND OF THE INVENTION

1. Field of the Invention

This invention relates to new and useful improvements in game boards and associated apparatus, and more particularly to a novel game board having a multi-level construction for play with chess pieces or the like.

2. Description of the Prior Art

The game of chess, played on a game board of bilaterally colored dark and light squares of eight squares on the side, has origins lost in antiquity. In modern times, there have been attempts to "improve" the game by changing the character of the playing pieces or the rules of the game.

Multi-level game boards are known for a variety of purposes.

Thompson U.S. Pat. No. 3,656,755 discloses a checker game having five identical vertically spaced game boards each shaped in the form of a pentagon divided into triangular playing areas.

Harper U.S. Pat. No. 3,884,474 describes and shows a multi-tiered game board for playing a variation on the game of tic-tac-toe.

Jones U.S. Pat. No. 3,804,416 illustrates a multi-tiered game board with apertures or sockets for receiving movable playing pieces.

Lehwalder U.S. Pat. No. 3,897,063 discloses a multi-tiered set of checker boards for playing a number of games simultaneously.

Additionally, a multi-level checker board of 2×2 squares was seen in the science fiction television series "Star Trek" many years ago. Further details of the game are not known to this inventor.

SUMMARY OF THE INVENTION

One of the objects of this invention is to provide a new and improved multi-level game board and associated playing apparatus.

Another object of this invention is to provide a new and improved multi-level game board apparatus of the chess or checker board type having portions of the board movable relative to other portions thereof.

Still another object of this invention is to provide a new and improved multi-level game board apparatus of the chess or checker board type having a plurality of board portions supported at different levels and some of such portions being rotatable relative to other portions thereof.

Other objects of this invention will become apparent from time to time throughout the specification and claims as hereinafter related.

These and other apparent objects of the invention are accomplished by a multi-level game board apparatus, adapted to be played with playing pieces such as chess men or the like, consisting of a chess or checker board divided into a plurality of levels for play. The board appears, in plan view, to have the arrangement of bilaterally colored dark and light squares of the shape and number of squares of a conventional chess or checker board.

The board, however, is separated into a central portion at one level and a plurality of surrounding portions of square configuration separately supported at least at one other level. The separate square portions supported at another level are separately supported on support members permitting rotation of each square portion about its center.

In the play of the game, the playing pieces are placed on the board initially, and are moved, as if all of the portions of the board were in a single plane. The game differs from a standard game board, however, in that one or more of said portions supported at different levels may be rotated to position a playing piece at a different relative location without moving the piece on the surface of the board.

DESCRIPTION OF THE PREFERRED EMBODIMENTS

Figure 1:
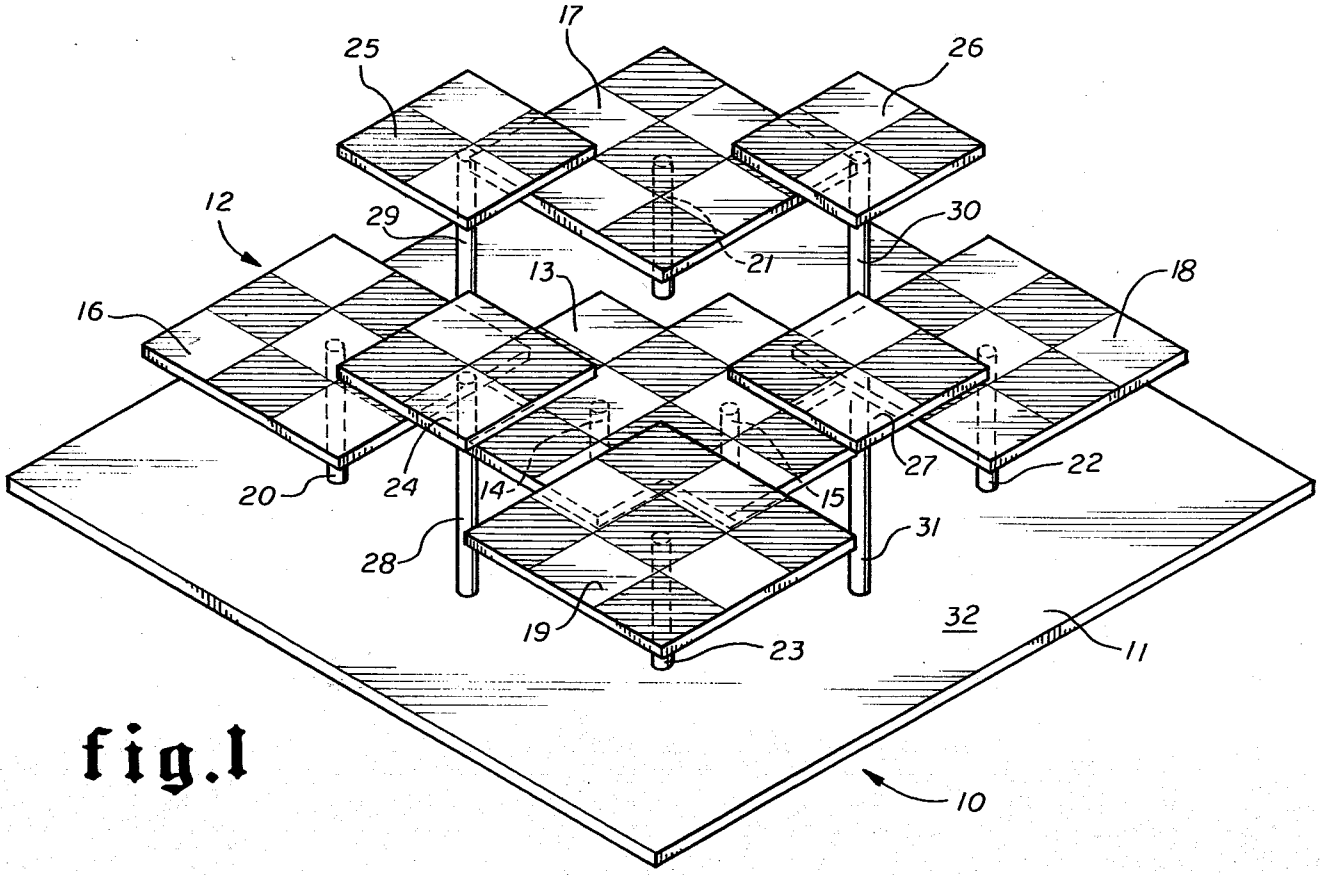
FIG. 1 is an isometric view of a preferred embodiment of a novel multi-level game board apparatus.
Figure 2:
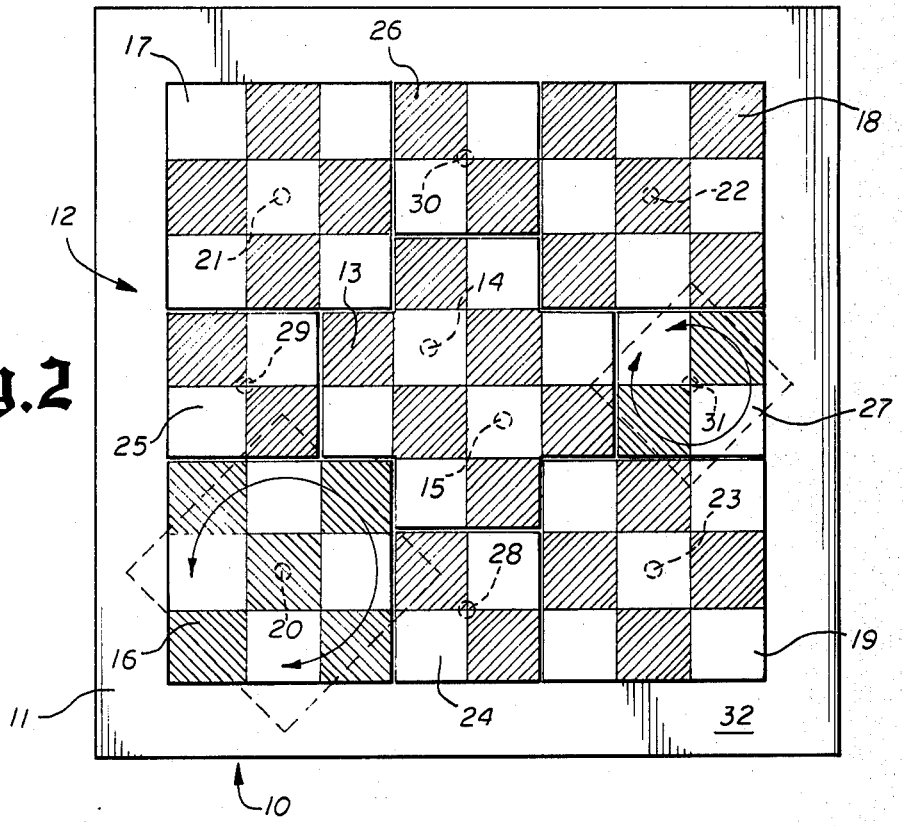
FIG. 2 is a plan view of the embodiment of the game board apparatus shown in FIG. 1 which illustrates the rotation of certain parts of the playing board.
Figure 3:
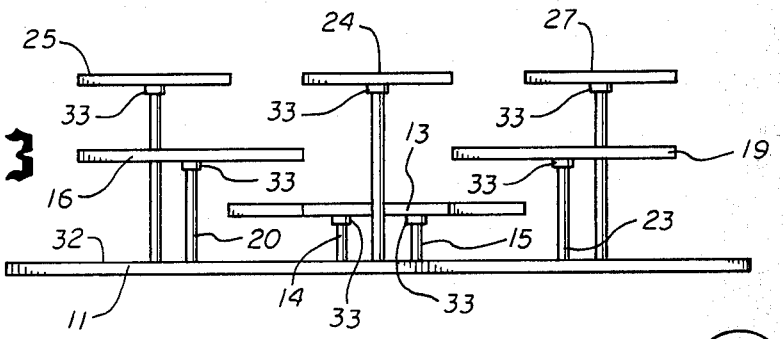
FIG. 3 is view in elevation of the embodiment of the apparatus shown in FIGS. 1 and 2.

Referring to the drawings by numerals of reference, and more particularly to FIGS. 1 to 3, there shown a multi level game board apparatus 10 consisting of a supporting board 11 and a multi part game board 12. Game board 12, as shown in the plan view in FIG. 2, is a standard checkerboard or chess board of bilaterally colored dark and light squares of eight squares on the side. Game board 12 is divided into a plurality of separate board portions which are supported at different levels on supporting board 10.

The central game board portion 13 is supported in a fixed position on a pair of supporting pins or rods 14 and 15 extending upward from supporting board 11. Central board portion 13 is in the shape of a cross having arms which are two squares in width and four squares long in each direction, as seen in FIGS. 1 and 2.

Central portion 13 of board 12 is surrounded by a plurality of square board portions which are of different size and which are supported at different levels in relation to the central portion and to each other. The central portion 13 is at the lowermost level which will be referred to as level 1. At the next level, which will be referred to level 2, there are provided plurality of square board portions 16, 17, 18 and 19 which are supported at their centers by supporting pins or rods 20, 21, 22 and 23, respectively. Square board portions 16–19 are 3×3 squares. At a still higher level, referred to as level 3, there are provided a plurality of square board portions 24, 25, 26 and 27 which are supported on pins or rods 28, 29, 30 and 31 respectively.

Supporting board 11 is preferably a rigid board of appreciable thickness as is seen in FIGS. 1 and 3. The board may be of wood or plastic sheet or the like. The upper surface 32 of board 11 is preferably finished as a mirror surface. The individual portions of playing board 12 preferably at least partially transparent. These pieces may be of a clear plastic material, such as an acrylic resin, and the dark and light squares formed by dyeing the plastic. The supporting rods or pins for the various portions of playing board 12 fit into recesses or holes in the supporting board 11. The upper portion of the supporting rods or pins fit into cylindrical bosses 33 on the bottom of each of the playing board portions.

The central, cross-shaped playing board portion 13 is supported on pins or rods 14 and 15 in a fixed position on board 11. The larger (3×3) square portions 16–19 of playing board 12 are supported at the middle of each portion by supporting pins or rods 20–23 and are rotatable thereon as indicated by the directional arrows seen in FIG. 2. The smaller (2×2) square portions 24–27 of playing board 12 are supported on pins or rods 28–31 at a higher level and are rotatable thereon as indicated by directional arrows seen in FIG. 2.

Figure 5:
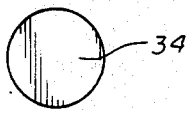
FIG. 5 is a view of a checker piece used with the game board shown in FIGS. 1, 2, and 3.
Figure 4:
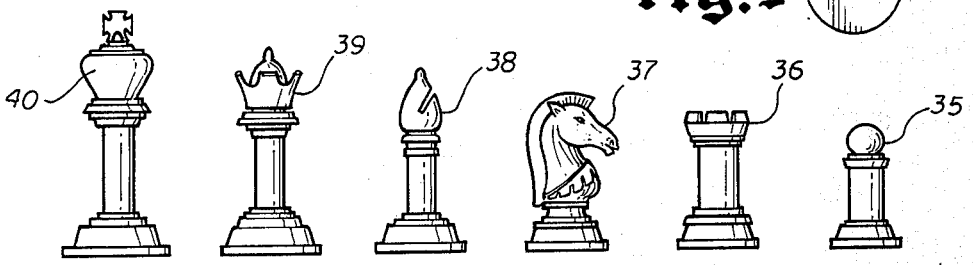
FIG. 4 is a view in elevation of a plurality of chess men for use in playing on the game board shown in FIGS. 1, 2 and 3.

The game board 12, as seen in FIG. 2, is in the form of a standard or conventional checker board or chess board but with the several portions of the board at the different levels. The board is used for playing either the game of checkers or the game of chess with certain variations in each game resulting from they rotatability of the square portions of the board supported at levels 2 and 3 thereof. In FIG. 5, there is shown a conventional checker 34 which is one member of a set of checkers which may be used for play on this game board apparatus. In FIG. 4, there are shown representative members of a chess set, viz. pawn 35, rook or castle 36, knight 37, bishop 38, king 39 and queen 40 which are from a set of chess men to be used on this game board apparatus.

PLAY OF THE GAME

The game board apparatus shown and described of is used for the play of games such as chess or checkers or the like, with modifications in the play of those games which may be related to the rotatability of the portions of the playing board at levels 2 and 3. As noted above, the first level of the board is located at the center and is the shape of a cross containing 12 squares with each arm of the cross being two squares wide by four squares long. Level 2 consists of four board portions containing nine squares each, located at the four corners of the board. Level 3 consists of four boards containing four squares each positioned in between the level 2 boards as viewed from above. The surface 32 of the base or the supporting board 11 is mirror and provides an interesting distraction to the play of the game where the individual playing board portions are transparent.

In using the game board for the game of chess, the individual playing piece are positioned on the board in the same initial position as if the board was constructed in a single plane. The playing pieces move exactly the same as in the ordinary game of chess with certain exceptions. As noted the pieces move according to the ordinary rules for movement of the individual chessmen along the surface of each playing board and from one level to another continuing on the board as if it was in a single plane. As previously noted, level 1 of the game board 12 is stationary while the boards on levels 2 and 3 are rotatable.

On level 2, the boards may be rotated only when the king is located thereon and is in check. When the king is in check, his player may rotate the board on which he is located instead of moving his allowed one space in any direction. The board can be rotated $\frac{1}{4}$ of a turn any time the king is in check. The rotation of the board can be either clockwise or counter clockwise.

On level 3 of the board, a player may choose to rotate any of the boards on which he has a playing piece. The board can be rotated $\frac{1}{4}$ turn or $\frac{1}{2}$ turn. Level 3 boards cannot be rotated if they have a king thereon, unless the king is in check, in which case the board can be rotated up to $\frac{3}{4}$ of a turn.

By rotating the boards on level 3, a player may produce a situation where the board has the same color squares immediately adjacent to each other, i.e. white against white or black against black. As a result of a move to this position, it may be necessary to vary the moves of certain of the pieces. If a bishop is on level 3 and the board is rotated $\frac{1}{4}$ turn, the bishop will be positioned adjacent the color on which it is located but will face diagonally along a new line of colored squares of the opposite color. As a result, the game rules are modified to permit the bishop to continue along the diagonal path which will be of the opposite color or to move sideways to the adjacent square of the same color and then proceed diagonally on its original color.

Bishops and queens, which move for long distances in a straight diagonal line, cannot travel through a level 3 board that has been rotated $\frac{1}{4}$ of a turn. Such pieces must stop at either of the other levels and the following turn may move 1 space to level 3. Once on level 3 the pieces then have the option of choosing a path as described above.

The rotation of level 3 boards have no effect on the movement of rooks or castles, knights and pawns, since these pieces are not limited to moving diagonally on a particular line of colored squares. The pawns, knights and castles or rooks can therefore travel through level 3 boards without stopping even though the boards have been rotated $\frac{1}{4}$ of a turn. The boards on level 3 can be rotated at the discretion of each individual player throughout the game as long as the rules for checking the king are followed.

In using the game board for the play of checkers, variations in play occur that are similar somewhat to the variations in the game of chess. In the use of the board, level 1 is stationary while levels 2 and 3 may rotate. The individual playing pieces or checkers must travel diagonally as in the normal game of checkers using a conventional checker board.

Level 2 playing board portions can be rotated to avoid capture of playing piece or checker, to improve one position on the board or to move an opponent back or away from a threatening position. The playing board portion on levels 2 and 3 can be rotated either clockwise or counter clockwise.

Level 3 board portions are rotatable to capture opponent pieces or checkers to prevent an opponent from capturing your pieces or checkers. These boards can be rotated only $\frac{1}{4}$ turn at a time. By rotating the level 3 boards $\frac{1}{4}$ turn, the squares are misaligned. As a result, the checker pieces can't move since they travel diagonally through the board. This makes it possible to protect one or two of the playing pieces on one board. The playing field can be reduced by $\frac{1}{4}$ if all four boards on level 3 are turned $\frac{1}{4}$ turn.

One need not have a playing piece on levels 2 or 3 to rotate them, but one's opponent cannot rotate the boards on the next move. Rather, he must make one move before that board can be rotated or any other board rotated. That rule applies to crowned pieces as well as uncrowned pieces. A further rule requires that a player must capture at least two opposing pieces before he can rotate any of the playing board portions.

A further privilege granted crowned pieces is that they can be moved into a level 3 board when the board is misaligned. Once the piece have been moved in, however, the board has to be rotated to allow the piece to move out. If the crowned piece is approaching a level 3 board which has been misaligned, the piece must stop before entering such board.

The variations possible in both the game of checkers and of chess, together with the visual disorientation produced by the mirror surface 32 of supporting board 11, results in this game board apparatus providing a challenging and interesting variation from the usual and normal games of checkers and chess.

While this invention have been described fully and completely with special emphasis upon a single preferred embodiment thereof, it should be understood that, within the scope of the appended claims, the invention may be practiced otherwise than as specifically described herein.

I claim:

1. A multi-level game board apparatus for use with a plurality of chess-like playing pieces, comprising a square game board of bilaterally colored light and dark squares, said board comprising a central portion and a plurality of surrounding separate portions, each of said surrounding portion being square in shape and cooperating to complete the square shape of said board, means supporting said board central portion at one level, means supporting said surrounding board portions at one or more different levels and laterally spaced to cooperate with said central portion to provide a substantially continuous game board in plan view, and said last named supporting means supporting at least some of said square surrounding board portions for rotary movement about the center of such square whereby playing pieces used on said board may be moved along the surface of said board portions or by rotation of one or more of said surrounding square board portions.

2. A multi-level game board apparatus according to claim 1 in which said central board portion has the shape of a cross, and said square surrounding portions are of two different sizes.

3. A multi-level game board apparatus according to claim 1 in which said board comprises an 8×8 arrangement of squares, said central board portion has the shape of a cross, and some of said square surrounding portions have a 2×2 arrangement of squares and some have a 3×3 arrangement of squares.

4. A multi-level game board apparatus according to claim 3 in which said central board portion has the shape of a cross, each arm of which is two squares wide by four squares long.

5. A multi-level game board apparatus according to claim 3 including a set of chess-men to be positioned on said game board in position corresponding to the normal positions of such pieces on a normal plane-type board and movable along the surface of each portion of said board and between different levels thereof according to the normal moves of such pieces on a plane-type board, and said surrounding board portions being rotatable under selected conditions of play to move a selected playing piece by such rotation instead of movement on the surface of said board.

6. A multi-level game board apparatus according to claim 1 in which said last named supporting means for said square surrounding portions support selected ones of said surrounding portions at different levels in relation to said central portion.

7. A multi-level game board apparatus according to claim 1 in which said board includes a supporting board, respective ones of said supporting means support said central portion at one level relative to said supporting board and said square surrounding portions at different levels in relation to each other and in relation to said central portion on said supporting board.

8. A multi-level game board apparatus according to claim 7 in which said central portion is supported in a fixed position on said supporting board and said square surrounding portions supported for rotation and at different levels in relation to said central portion on said supporting board.

9. A multi-level game board apparatus according to claim 1 in which said supporting board has a mirror surface, and said central board portion and said square surrounding portions are at least partially transparent to permit playing pieces positioned thereon to be seen in said mirror surface.

* * * * *